US005392671A

United States Patent [19]

Hazzard

[11] Patent Number: 5,392,671

[45] Date of Patent: Feb. 28, 1995

[54] POWER-DRIVEN WRENCH APPARATUS

[76] Inventor: William M. Hazzard, 633 George St., Norristown, Pa. 19401

[21] Appl. No.: 158,865

[22] Filed: Nov. 29, 1993

[51] Int. Cl.[6] ..... B25B 17/00

[52] U.S. Cl. ..... 81/57.13; 81/57.29; 81/57.46

[58] Field of Search ..... 81/57.13, 57.29, 57.46, 81/58.2

[56] References Cited

U.S. PATENT DOCUMENTS

| | | | |
|---|---|---|---|
| 2,693,728 | 11/1954 | Shaff | 81/57.13 |
| 3,668,949 | 6/1972 | Walker | 81/57.13 |
| 4,215,601 | 8/1980 | Mann | 81/57.13 |
| 4,322,989 | 4/1982 | Garolis | 81/57.13 |

FOREIGN PATENT DOCUMENTS

| | | | |
|---|---|---|---|
| 2229664 | 10/1990 | United Kingdom | 81/57.13 |

*Primary Examiner*—James G. Smith

[57] ABSTRACT

A new and improved power-driven wrench apparatus includes a housing assembly which includes a gear box portion, a pair of flexible shaft retention portions that extend outwardly from the gear box portion, respective bearing supports located on the flexible shaft retention portions, and a wrench head bearing assembly supported by the bearing supports of the housing assembly. The first gear assembly receives power from a power source. A pair of flexible-shaft gear assemblies is provided wherein each assembly includes a respective driven gear which meshes with the first gear assembly. A respective flexible shaft is connected to the respective driven gear, and a respective worm gear is connected to the respective flexible shaft. The respective driven gears are housed in the gear box portion of the housing assembly, and the pair of flexible-shaft gear assemblies and the respective worm gears are housed in the flexible shaft retention portions of the housing assembly. A cylindrical wrench head assembly is supported by the wrench head bearing assembly on the flexible shaft retention portions of the housing assembly. The cylindrical wrench head assembly includes a circumferential array of gear teeth for meshing with the respective worm gears of the flexible-shaft gear assemblies, such that the worm gears of the flexible-shaft gear assemblies rotate the cylindrical wrench head assembly around a central longitudinal axis which is perpendicular to the plane in which the flexible shaft retention portions of the housing assembly lie.

13 Claims, 4 Drawing Sheets

POWER-DRIVEN WRENCH APPARATUS

BACKGROUND OF THE INVENTION

1. Field of the Invention

The present invention relates generally to wrenches, and, more particularly, to wrenches that are driven by a power source.

2. Description of the Prior Art

Wrenches are available in a wide variety shapes and configurations for a wide variety of applications. More specifically, wrenches have either closed ends or open ends. In certain instances, a nut or bolt head is accessible to a wrench from directly above or from directly below the nut or bolt head. That is, the wrench can cross the longitudinal axis which passes through the bolt to which the nut or bolt head is attached in order to place the wrench on the nut or bolt head. When such is the case, then either an open end or a closed end wrench can be employed for turning the nut or bolt head.

However, there are also situations in which it is desired to place the wrench on the nut or bolt head, but the nut or bolt head cannot be accessed by having the wrench cross the longitudinal axis which passes through the bolt to which the nut or bolt head is attached. For example, a nut may be positioned half way between two ends of a long rod or cable. In such a case, the nut cannot be accessed by a wrench from directly above or directly below the nut. The long portions of the rod or cable prevent such access. In this respect, it would be desirable if a wrench device were provided which permits a nut to be accessed by the wrench when the nut is positioned at an intermediate position between two ends of a rod or cable.

Wrenches are also characterized as to whether they are powered manually or powered by a nonmanual source of power. Manual wrenches come in a number of forms that are capable of accessing nuts or bolt heads in a wide variety of ways. For example, some manual wrenches can access nuts or bolt heads from directly above or directly below the nut or bolt head. Other manual wrenches can access a nut or bolt head from the side of the nut or bolt head.

Power wrenches, however, generally access a nut or bolt head from directly above or directly below the nut or bolt head. These power wrenches have a power source that rotates along the same longitudinal axis around which the nut or bolt head turns. Power wrenches are not provided that can access a nut or bolt head from the side of the nut or bolt head. In this respect, it would be desirable if a power wrench device were provided which can access a nut or bolt head from the side of the nut or bolt head.

Wrenches that permit access to a nut or bolt head from the side of the nut or bolt head are open-ended wrenches and generally include a C-shaped head. However, wrenches that have a C-shaped head are manually powered, not powered by an nonmanual power source. In this respect, it would be desirable if a power wrench device were provided which included a C-shaped head.

Moreover, wrenches that permit access to a nut or bolt head from a side generally have a lever arm and apply a torque to the nut or bolt head from a force applied tangential to the lever arm. Wrenches that have a lever arm to provide a torque to the nut or bolt head may have either a C-shaped head or a box-shaped, closed head, and such wrenches are manually powered. Generally, wrenches that permit access to a nut or bolt head from a side of the nut or bolt head, whether they have a C-shaped open head or a box-shaped closed head, are manually powered. In this respect, it would be desirable if a power wrench device were provided that permits access to a nut or bolt head from a side of the nut or bolt head whether the wrench has a C-shaped open head or a box-shaped closed head.

When manually powered wrenches are used, the mode of operation generally requires a reciprocating cranking motion. That is, the wrench head is placed on the nut or bolt head with the lever arm being in an initial position. The lever arm is moved in one direction to a certain extent to tighten or loosen the nut or bolt head as the case may be. The wrench head is removed from the nut or bolt head. The lever arm is moved back to the starting position. The wrench head is placed again on the nut or bolt head, and the steps are repeated over and over again. In contrast, when power wrenches are used, a continuous circular motion is generally present. In this respect, it would be desirable if a power wrench device were provided that permits access to a nut or bolt head from a side of the nut or bolt head and that provides a continuous circular drive motion.

As mentioned above, wrenches that permit access to a nut or bolt head from a side generally have a lever arm. Aside from its characteristic of permitting application of a tangential torque, the lever arm may serve a more basic function of extending the reach of a person's hand to tight quarters not reachable by a person's hand. In this respect, it would be desirable if a power wrench device were provided which included a lever arm that extends the reach of a person's hand to tight quarters not reachable by the person's hand.

Throughout the years, a number of innovations have been developed relating to wrenches, and the following U.S. Pat. Nos. are representative of some of those innovations: 3,097,551; 3,519,046; 4,186,629; 4,399,721; and 4,914,987. More specifically, U.S. Pat. Nos. 3,097,551, 3,519,046, and 4,186,629 disclose power wrenches which have a power source that rotates along the same longitudinal axis around which the nut or bolt head turns.

Turning to another aspect of prior art wrenches, U.S. Pat. No. 4,399,721 discloses a manually operated device in which a worm screw is used for tightening or loosening turnbuckles. In addition, U.S. Pat. No. 4,914,987 discloses a manually operated tube coupling device that uses a worm screw for tightening or loosening tube couplings. A worm screw has an advantage in being capable of being continuously turned in one direction without the need for a reciprocating start and stop action described above for wrenches employing a lever arm. In this respect, it would be desirable if a power wrench device were provided with a lever arm for easy access to certain nuts or bolt heads and which employed a worm screw that is continuously turned in one direction during operation.

Thus, while the foregoing body of prior art indicates it to be well known to use power wrenches, the prior art described above does not teach or suggest a power-driven wrench apparatus which has the following combination of desirable features: (1) permits a nut to be accessed by the wrench when the nut is positioned at an intermediate position between two ends of a rod or cable; (2) can access a nut or bolt head from the side of the nut or bolt head; (3) can include a C-shaped head; (4) permits access to a nut or bolt head from a side of the nut or bolt head whether the wrench has a C-shaped open head or a box-shaped closed head; (5) provides a continuous circular drive motion; (6) includes a lever arm that extends the reach of a person's hand to tight quarters not reachable by the person's hand; and (7) is provided with a lever arm for easy access to certain nuts or bolt heads and employs a worm screw that is continuously turned in one direction during operation. The foregoing desired characteristics are provided by the unique power-driven wrench apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved power-driven wrench apparatus which includes a housing assembly which includes a gear box portion, a pair of flexible shaft retention portions that extend outwardly from the gear box portion, respective bearing supports located on the flexible shaft retention portions, and a wrench head bearing assembly supported by the bearing supports of the housing assembly. The flexible shaft retention portions lie in a first plane. A first gear assembly is supported by the gear box portion of the housing assembly. The first gear assembly receives power from a power source. A pair of flexible-shaft gear assemblies is provided wherein each assembly includes a respective driven gear which meshes with the first gear assembly. A respective flexible shaft is connected to the respective driven gear, and a respective worm gear is connected to the respective flexible shaft. The respective driven gears are housed in the gear box portion of the housing assembly, and the pair of flexible-shaft gear assemblies and the respective worm gears are housed in the flexible shaft retention portions of the housing assembly. A cylindrical wrench head assembly is supported by the wrench head bearing assembly on the flexible shaft retention portions of the housing assembly.

The cylindrical wrench head assembly includes a circumferential array of gear teeth for meshing with the respective worm gears of the flexible-shaft gear assemblies, such that the worm gears of the flexible-shaft gear assemblies rotate the cylindrical wrench head assembly around a central longitudinal axis which is perpendicular to the first plane in which the flexible shaft retention portions of the housing assembly lie.

The cylindrical wrench head assembly is in the form of a C-shaped head. The dimensions of the worm gears and the C-shaped wrench head are provided such that one of the worm gears engages the circumferential array of gear teeth on the cylindrical wrench head assembly when the C-shaped cylindrical wrench head assembly is adjacent the other of the worm gears. In this way, the cylindrical wrench head assembly is constantly driven by the power supplied by the power module.

The wrench head bearing assembly includes a pair of C-shaped, flexible rings supported by the flexible shaft retention portions and secured to the flexible shaft retention portions by the bearing supports. Complementary grooves are present in the flexible shaft retention portions for receiving the C-shaped, flexible rings for supporting the cylindrical wrench head assembly.

The gear box portion of the housing assembly includes a bottom portion and a top portion secured to the bottom portion by screws. The flexible shaft retention portions include a first groove portion for receiving the flexible shaft and a second groove portion for receiving the worm gear.

The worm gear includes a bearing that fits into a bearing-receiving well in the flexible shaft retention portions. The respective driven gears of the respective flexible-shaft gear assemblies include respective bearings. The gear box portion includes bearing-receiving wells for receiving the respective axle assemblies of the flexible-shaft gear assemblies. The first gear assembly includes a first gear portion for connecting to the power source. A second gear portion is connected to the first gear portion for driving the respective driven gears of the flexible-shaft gear assemblies. The first gear portion and the second gear portion are supported by a common axle.

The housing assembly includes a bottom portion which includes respective wells for receiving respective ends of the axle. The power source is in the form of a power module that includes complementary threads for receiving a threaded end of the housing assembly.

The gear box portion of the housing assembly includes wells for receiving respective flexible shafts of the flexible-shaft gear assemblies.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved power-driven wrench apparatus which has all of the advantages of the prior art and none of the disadvantages.

It is another object of the present invention to provide a new and improved power-driven wrench apparatus which may be easily and efficiently manufactured and marketed.

It is a further object of the present invention to provide a new and improved power-driven wrench apparatus which is of durable and reliable construction.

An even further object of the present invention is to provide a new and improved power-driven wrench apparatus which is susceptible of a low cost of manufacture with regard to both materials and labor, and which accordingly is then susceptible of low prices of sale to the consuming public, thereby making such power-driven wrench apparatus available to the buying public.

Still yet a further object of the present invention is to provide a new and improved power-driven wrench apparatus which permits a nut to be accessed by the wrench when the nut is positioned at an intermediate position between two ends of a rod or cable.

Still another object of the present invention is to provide a new and improved power-driven wrench apparatus that can access a nut or bolt head from the side of the nut or bolt head.

Yet another object of the present invention is to provide a new and improved power-driven wrench apparatus which can include a C-shaped head.

Even another object of the present invention is to provide a new and improved power-driven wrench apparatus that permits access to a nut or bolt head from a side of the nut or bolt head whether the wrench has a C-shaped open head or a box-shaped closed head.

Still a further object of the present invention is to provide a new and improved power-driven wrench apparatus which provides a continuous circular drive motion.

Yet another object of the present invention is to provide a new and improved power-driven wrench apparatus that includes a lever arm that extends the reach of a person's hand to tight quarters not reachable by the person's hand.

Still another object of the present invention is to provide a new and improved power-driven wrench apparatus which is provided with a lever arm for easy access to certain nuts or bolt heads and employs a worm screw that is continuously turned in one direction during operation.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
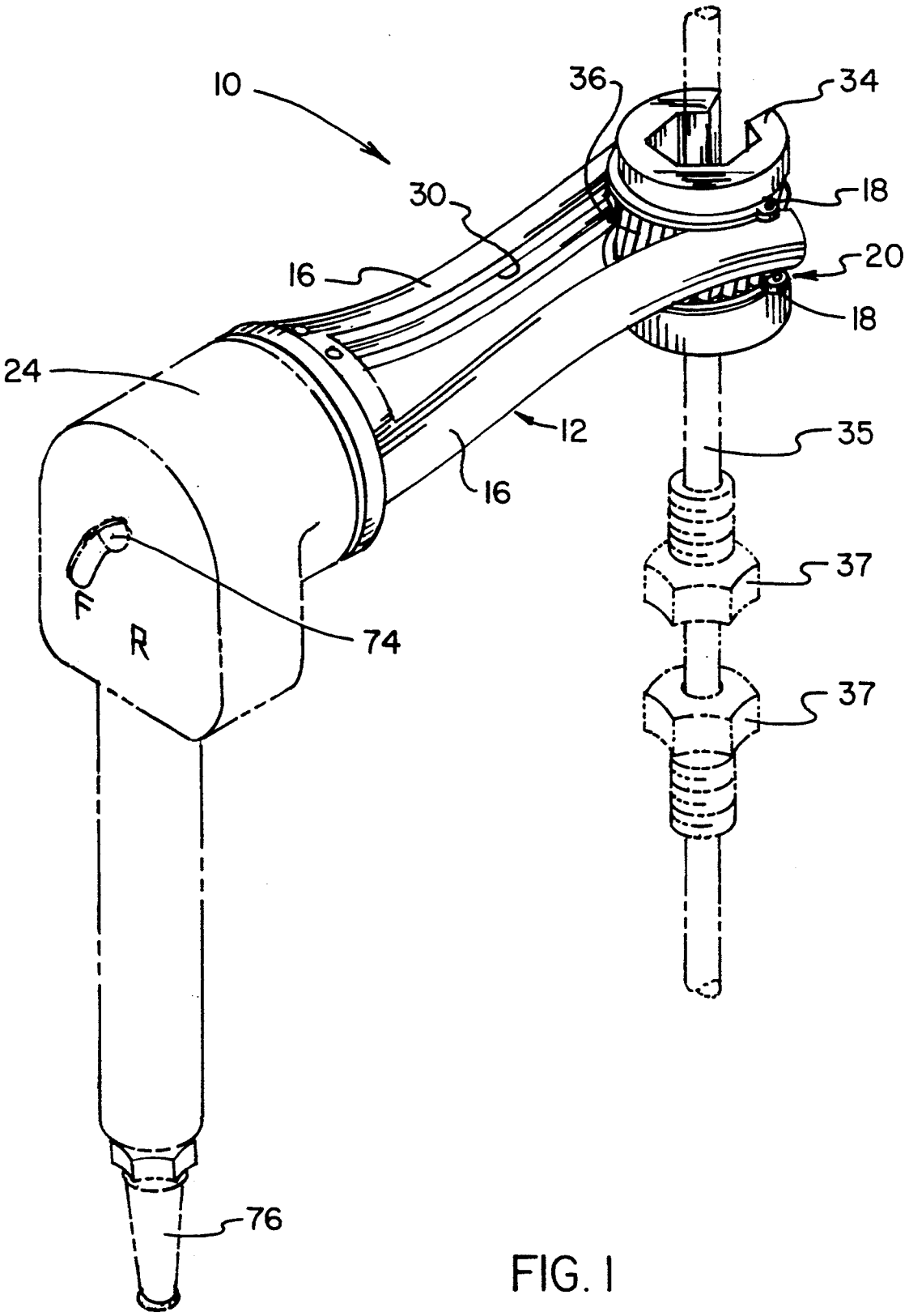
FIG. 1 is a perspective view, viewed from the back, showing a preferred embodiment of the power-driven wrench apparatus of the invention about to be used to drive a nut on a cable.
Figure 3:
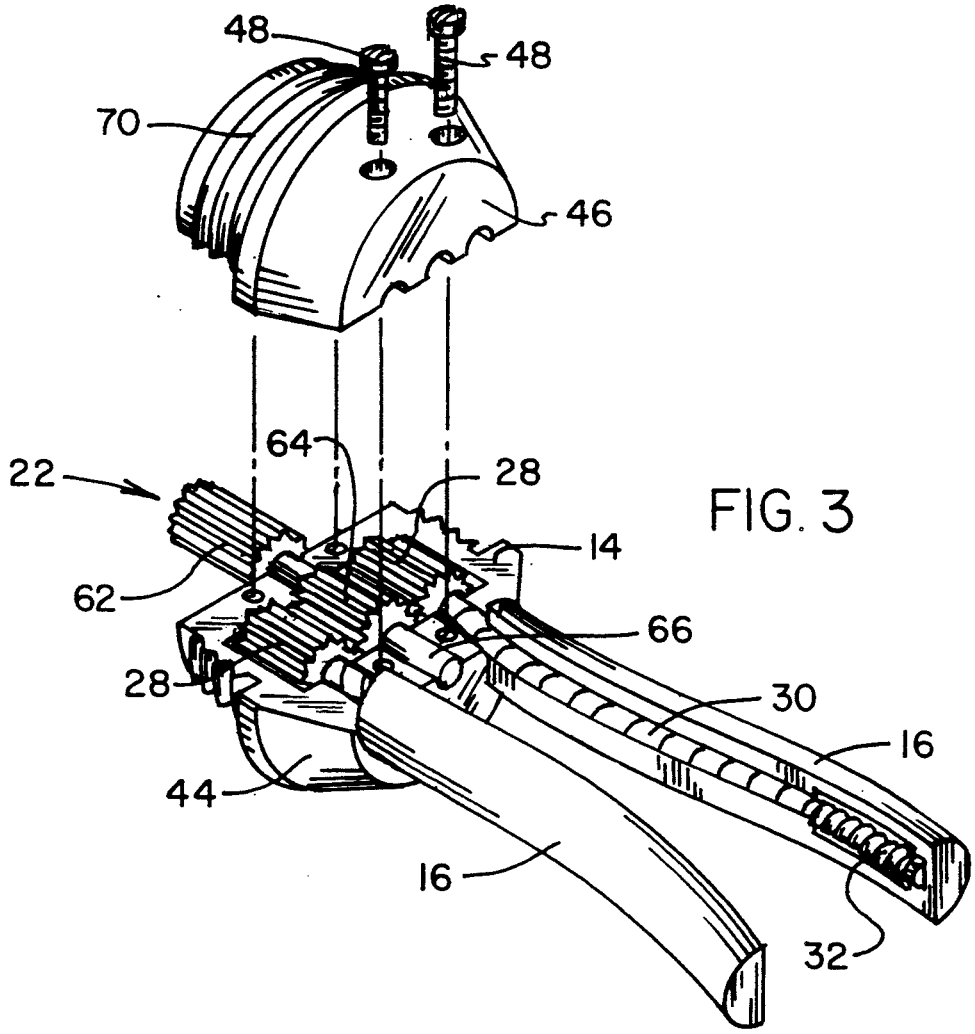
FIG. 3 is a partially exploded view of the embodiment of the invention shown in FIG. 2 with a C-shaped head removed.
Figure 2:
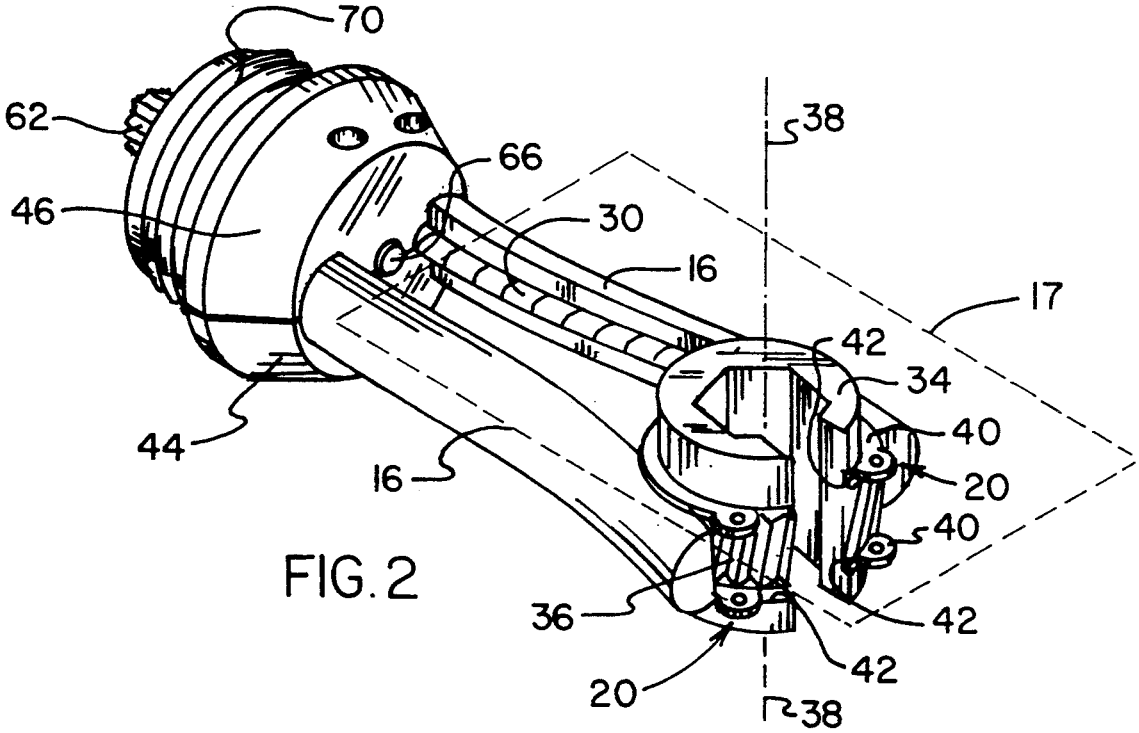
FIG. 2 is a perspective view, view from the front, of the driven portion of the power-driven wrench apparatus shown in FIG. 1.
Figures 4, 5:
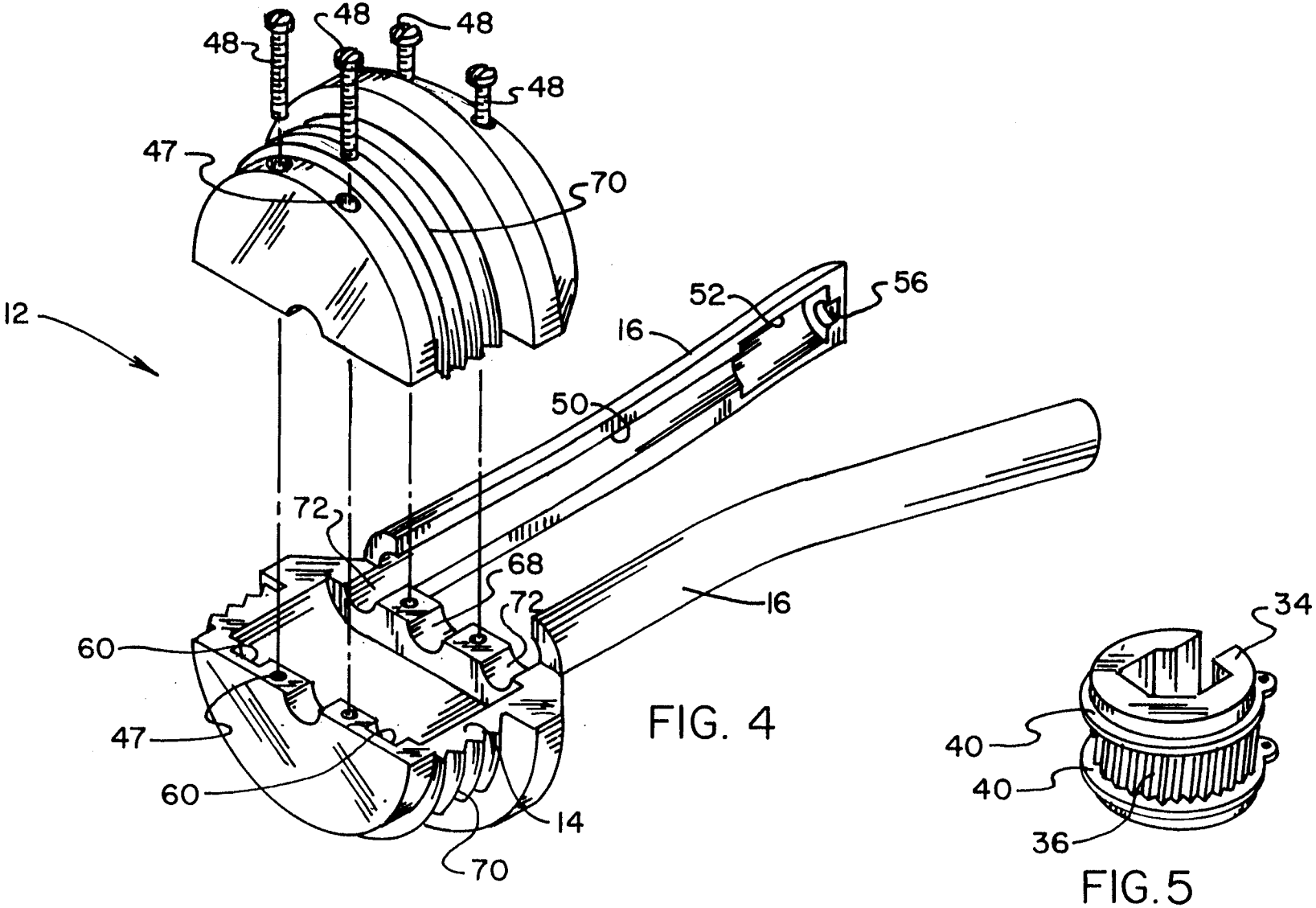
FIG. 4 is an enlarged perspective view of the housing members of the embodiment of the invention shown in FIGS. 2 and 3.
FIG. 5 is a perspective view of the C-shaped head used with the embodiment of the invention shown in FIGS. 1 and 2.
Figures 6, 7, 8:
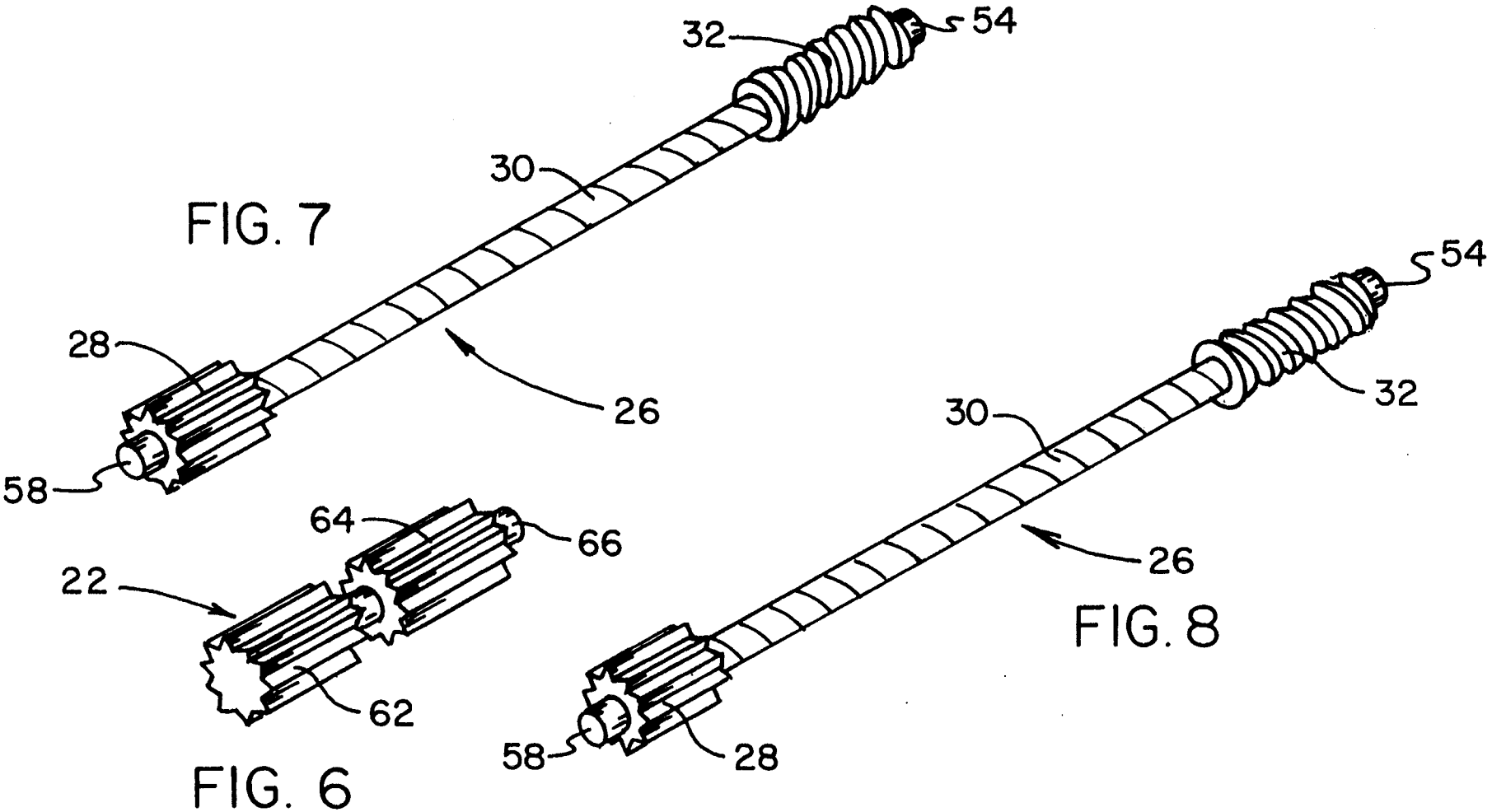
FIG. 6 is a perspective view of the first gear in the power train assembly for the embodiment of the invention shown in FIG. 3.
FIGS. 7 and 8 are respective perspective views of the flexible shafts and worm gears used in the embodiment of the invention shown in FIGS. 2 and 3.

With reference to the drawings, a new and improved power-driven wrench apparatus embodying the principles and concepts of the present invention will be described.

Turning to the Figures, there is shown a preferred embodiment of the power-driven wrench apparatus of the invention generally designated by reference numeral 10. The power-driven wrench apparatus 10 includes a housing assembly 12 which includes a gear box portion 14, a pair of flexible shaft retention portions 16 that extend outwardly from the gear box portion 14, respective bearing supports 18 located on the flexible shaft retention portions 16, and a wrench head bearing assembly 20 supported by the bearing supports 18 of the housing assembly 12. The flexible shaft retention portions 16 lie in a first plane 17. The bearing supports 18 are pins 18. First gear assembly 22 is supported by the gear box portion 14 of the housing assembly 12. The first gear assembly 22 receives power from a power source 24. A pair of flexible-shaft gear assemblies 26 is provided wherein each assembly includes a respective driven gear 28 which meshes with the first gear assembly 22. A respective flexible shaft 30 is connected to the respective driven gear 28, and a respective worm gear 32 is connected to the respective flexible shaft 30. The respective driven gears 28 are housed in the gear box portion 14 of the housing assembly 12, and the pair of flexible-shaft gear assemblies 26 and the respective worm gears 32 are housed in the flexible shaft retention portions 16 of the housing assembly 12. A cylindrical wrench head assembly 34 is supported by the wrench head bearing assembly 20 on the flexible shaft retention portions 16 of the housing assembly 12.

The cylindrical wrench head assembly 34 includes a circumferential array of gear teeth 36 for meshing with the respective worm gears 32 of the flexible-shaft gear assemblies 26, such that the worm gears 32 of the flexible-shaft gear assemblies 26 rotate the cylindrical wrench head assembly 34 around a central longitudinal axis 38 which is perpendicular to the first plane 17 in which the flexible shaft retention portions 16 of the housing assembly 12 lie.

The cylindrical wrench head assembly 34 is in the form of a C-shaped head. As shown in FIG. 1, the C-shaped head 34 permits a cable 35 to be moved into the cylindrical wrench head assembly 34. Then, the cylindrical wrench head assembly 34 can be lowered along the cable 35 to engage the nuts 37 that are located on the cable 35. The dimensions of the respective worm gears 32 and the respective C-shaped wrench head are such that wherein one of the worm gears 32 engages the circumferential array of gear teeth 36 on the cylindrical wrench head assembly 34 when the C-shaped cylindrical wrench head assembly 34 is adjacent the other of the worm gears 32.

The wrench head bearing assembly 20 includes a pair of C-shaped, flexible rings 40 supported by the flexible shaft retention portions 16 and secured to the flexible shaft retention portions 16 by the bearing supports 18, e.g. pins 18. Complementary grooves 42 are present in the flexible shaft retention portions 16 for receiving the C-shaped, flexible rings 40 for supporting the cylindrical wrench head assembly 34.

The gear box portion 14 of the housing assembly 12 includes a bottom portion 44 and a top portion 46 secured to the bottom portion 44 by screws 48. The top portion 46 and the bottom portion 44 of the gear box portion 14 of the housing assembly 12 include threaded channels 47 that are placed in registration when the top portion 46 is placed in the bottom portion 44. The screws 48 are placed in the threaded channels 47 and are used to secure the top portion 46 to the bottom portion 44 of the gear box portion 14. The flexible shaft retention portions 16 include a first groove portion 50 for receiving the flexible shaft 30 and a second groove portion 52 for receiving the worm gear 32.

The worm gear 32 includes a bearing 54 that fits into a bearing-receiving well 56 in the flexible shaft retention portions 16. The respective driven gears 28 of the respective flexible-shaft gear assemblies 26 include respective bearings 58. The gear box portion 14 includes bearing-receiving wells 60 for receiving the respective axle assemblies 58 of the flexible-shaft gear assemblies 26. The first gear assembly 22 includes a first gear portion 62 for connecting to the power source 24. A second gear portion 64 is connected to the first gear portion 62 for driving the respective driven gears 28 of the flexible-shaft gear assemblies 26. The first gear portion 62 and the second gear portion 64 are supported by a common axle 66.

The housing assembly 12 includes a bottom portion 44 which includes respective wells 68 for receiving respective ends of the axle 66. The power source 24 is in the form of a power module 24 that includes complementary threads for receiving a threaded end 70 of the housing assembly 12. The power module 24 shown in FIG. 1 is powered by hydraulic pressure. In addition, the power module 24 has selectable directional operation. A switch 74 is provided for switching the power module 24 from a forward mode to a reverse mode. Nipple 76 is used to connect the power module 24 to a source of hydraulic pressure (not shown). The power module 24 is provided with a gear system (not shown) that includes a gear for meshing with and driving the first gear portion 62 of the first gear assembly 22.

The gear box portion 14 of the housing assembly 12 includes wells 72 for receiving respective flexible shafts 30 of the flexible-shaft gear assemblies 26.

In use, the power module 24 receives hydraulic power from a power source. The power module 24 drives the first gear portion 62 of the first gear assembly 22 which drives the second gear portion 64 of the first gear assembly 22. The second gear portion 64 is enmeshed with the respective driven gears 28 of the respective flexible-shaft gear assemblies 26. The respective driven gears 28 turn the respective flexible shafts 30, and the respective flexible shafts 30 rotate the respective worm gears 32. The worm gears 32 are enmeshed with the circumferential array of gear teeth 36 on the cylindrical wrench head assembly 34 and cause the cylindrical wrench head assembly 34 to rotate in a circle around the longitudinal axis 38. When the cylindrical wrench head assembly 34 is fitted to a nut 37, the nut 37 is turned by the power provided by the power module 24. The cylindrical wrench head assembly 34 is supported by the wrench head bearing assembly 20. As the cylindrical wrench head assembly 34 rotates around the longitudinal axis 38, the bearing supports 18 retain the C-shaped, flexible rings 40 in position in the complementary grooves 42 in the cylindrical wrench head assembly 34. The flexible shaft retention portions 16 of the housing assembly 12 are rigid and support the cylindrical wrench head assembly 34 and retain the cylindrical wrench head assembly 34 in proper position as the cylindrical wrench head assembly 34 rotates around the longitudinal axis 38.

As shown in the drawings, the cylindrical wrench head assembly 34 is in the form of a C-shaped wrench head. Alternatively, the wrench head can be a box-shaped, closed head.

The power module 24 can be a standard automotive 3/8 inch air wrench motor. A specific application of the power-driven wrench apparatus of the invention is for loosening or tightening a flair nut such as found in automatic transmissions, power steering lines, or brake lines. The power-driven wrench apparatus of the invention will turn a nut 360 degrees without alternately removing and replacing a wrench for the nut.

The components of the power-driven wrench apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved power-driven wrench apparatus that is low in cost, relatively simple in design and operation, and which may advantageously be used to access a nut or bolt head the nut or bolt head is positioned at an intermediate position between two ends of a rod or cable. With the invention, a power-driven wrench apparatus is provided which can access a nut or bolt head from the side of the nut or bolt head. With the invention, a power-driven wrench apparatus is provided which can include a C-shaped head. With the invention, a power-driven wrench apparatus is provided which permits access to a nut or bolt head from a side of the nut or bolt head whether the wrench has a C-shaped open head or a box-shaped closed head. With the invention, a power-driven wrench apparatus is provided which provides a continuous circular drive motion. With the invention, a power-driven wrench apparatus is provided which includes a lever arm that extends the reach of a person's hand to tight quarters not reachable by the person's hand. With the invention, a power-driven wrench apparatus is provided with a lever arm for easy access to certain nuts or bolt heads and employs a worm screw that is continuously turned in one direction during operation.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved power-driven wrench apparatus, comprising:

a housing assembly which includes a gear box portion, a pair of flexible shaft retention portions that extend outwardly from said gear box portion, and respective bearing supports located on said flexible shaft retention portions, wherein said flexible shaft retention portions lie in a first plane, a wrench head bearing assembly supported by said bearing supports of said housing assembly, a first gear assembly supported by said gear box portion of said housing assembly, said first gear assembly receiving power from a power source, a pair of flexible-shaft gear assemblies, each of which includes a respective driven gear which meshes with said first gear assembly, a respective flexible shaft connected to said respective driven gear, and a respective worm gear end connected to said respective flexible shaft, said respective driven gears being housed in said gear box portion of said housing assembly, and said pair of flexible-shafts and said-respective worm gear ends being housed in said flexible shaft retention portions of said housing assembly, and a cylindrical wrench head assembly supported by said wrench head bearing assembly on said flexible shaft retention portions of said housing assembly, said cylindrical wrench head assembly including a circumferential array of gear teeth for meshing with said respective worm gear ends of said flexible-shaft gear assemblies, such that said worm gear ends of said flexible-shaft gear assemblies rotate said cylindrical wrench head assembly around a central longitudinal axis which is perpendicular to said first plane in which said flexible shaft retention portions of said housing assembly lie.

2. The apparatus described in claim 1 wherein said cylindrical wrench head assembly is in the form of a C-shaped head.

3. The apparatus described in claim 2 wherein one of said worm gear ends engages said circumferential array of gear teeth on said cylindrical wrench head assembly when said C-shaped cylindrical wrench head assembly is adjacent the other of said worm gears.

4. The apparatus described in claim 1 wherein:

said wrench head bearing assembly includes a pair of C-shaped, flexible rings supported by said flexible shaft retention portions and secured to said flexible shaft retention portions by said bearing supports, and complementary grooves are present in said flexible shaft retention portions for receiving said C-shaped, flexible rings for supporting said cylindrical wrench head assembly.

5. The apparatus descried in claim 1 wherein said gear box portion of said housing assembly includes a bottom portion and a top portion secured to said bottom portion by screws.

6. The apparatus described in claim 1 wherein said flexible shaft retention portions include a first groove portion for receiving said flexible shaft and a second groove portion for receiving said worm gear end.

7. The apparatus described in claim 1 wherein said worm gear end includes a bearing that fits into a bearing-receiving well in said flexible shaft retention portions.

8. The apparatus described in claim 7 wherein said respective driven gears of said respective flexible-shaft gear assemblies include respective bearings.

9. The apparatus described in claim 1 wherein said gear box portion includes bearing-receiving wells for receiving respective axle assemblies of said flexible-shaft gear assemblies.

10. The apparatus described in claim 1 wherein said first gear assembly includes:

a first gear portion for connecting to the power source, and a second gear portion, connected to said first gear portion, for driving said respective driven gears of said flexible-shaft gear assemblies, wherein said first gear portion and said second gear portion are supported by a common axle.

11. The apparatus described in claim 10 wherein said housing assembly includes a bottom portion which includes respective wells for receiving respective ends of said axle.

12. The apparatus described in claim 1 wherein the power source is in the form of a power module that includes complementary threads for receiving a threaded end of said housing assembly.

13. The apparatus described in claim 1 wherein said gear box portion of said housing assembly includes wells for receiving respective flexible shafts of said flexible-shaft gear assemblies.

* * * * *